US008371232B2

(12) United States Patent
Kumar et al.

(10) Patent No.: US 8,371,232 B2
(45) Date of Patent: Feb. 12, 2013

(54) SYSTEM AND METHOD FOR MODIFICATION OF A BASELINE BALLAST ARRANGEMENT OF A LOCOMOTIVE

(75) Inventors: Ajith Kuttannair Kumar, Erie, PA (US); Bret Dwayne Worden, Union City, PA (US)

(73) Assignee: General Electric Company, Schenectady, NY (US)

( * ) Notice: Subject to any disclaimer, the term of this patent is extended or adjusted under 35 U.S.C. 154(b) by 196 days.

(21) Appl. No.: 12/869,083

(22) Filed: Aug. 26, 2010

(65) Prior Publication Data

US 2010/0319567 A1 Dec. 23, 2010

Related U.S. Application Data

(63) Continuation-in-part of application No. 11/833,858, filed on Aug. 3, 2007, now abandoned.

(51) Int. Cl.
*B61C 15/04* (2006.01)
*B61C 15/06* (2006.01)
*B61C 15/14* (2006.01)

(52) U.S. Cl. ..... 105/75; 105/73

(58) Field of Classification Search ..... 105/34.1, 105/34.2, 75, 82, 194, 209, 73
See application file for complete search history.

(56) References Cited

U.S. PATENT DOCUMENTS

| | | | |
|---|---|---|---|
| 598,403 | A | 2/1898 | Uebelacker |
| 1,020,607 | A | 3/1912 | Hunt |
| 3,908,559 | A | 9/1975 | Fromm |
| 4,399,881 | A | 8/1983 | Theurer et al. |
| 4,809,616 | A | 3/1989 | Piel |
| 6,267,062 | B1 | 7/2001 | Hamilton, Jr. |
| 2007/0001629 | A1 | 1/2007 | McGarry et al. |
| 2009/0031915 | A1 | 2/2009 | Kumer et al. |
| 2009/0031917 | A1 | 2/2009 | Kumer et al. |

FOREIGN PATENT DOCUMENTS

| | | | |
|---|---|---|---|
| DE | 10 35 681 | B | 8/1958 |
| DE | 28 27 112 | | 12/1979 |
| FR | 1 279 890 | A | 12/1961 |
| FR | 1 289 653 | | 4/1962 |
| FR | 2 430 880 | | 2/1980 |
| GB | 562 542 | A | 7/1944 |
| GB | 1 116 012 | A | 6/1968 |
| JP | 2006 137238 | A | 6/2006 |
| RU | 2007316 | C1 | 2/1994 |
| SU | 1 525 056 | A1 | 11/1989 |

*Primary Examiner* — S. Joseph Morano
*Assistant Examiner* — Zachary Kuhfuss
(74) *Attorney, Agent, or Firm* — GE Global Patent Operation; John A. Kramer

(57) ABSTRACT

A system and method for modification of a baseline ballast arrangement of a locomotive (or other rail vehicle) having an overall tractive effort rating based on symmetrical distribution of weight and driving torque applied by the locomotive to the respective axles of the locomotive. The system includes a locomotive (or other rail vehicle) truck comprising an unpowered first axle and a powered second axle. The system also includes a first suspension assembly configured to apply to the first axle a first portion of a locomotive weight and a second suspension assembly configured to apply to the second axle a second portion of the locomotive weight different from the first portion. An amount of locomotive weight allocated from the first axle to the second axle allows modification of a baseline ballast arrangement by reducing an amount of ballast in the baseline ballast arrangement corresponding to the amount of weight allocated from the first axle to the second axle. The axle weight distribution involves relatively slight weight distribution compared to the nominal weights normally carried by the axles.

22 Claims, 3 Drawing Sheets

SYSTEM AND METHOD FOR MODIFICATION OF A BASELINE BALLAST ARRANGEMENT OF A LOCOMOTIVE

RELATED APPLICATIONS

This application is a continuation-in-part (CIP) application of U.S. patent application Ser. No. 11/833,858, filed on Aug. 3, 2007 now abandoned, which is herein incorporated by reference in its entirety.

FIELD

The subject matter herein relates to locomotives, and, more particularly, to a system and method for modification of a baseline ballast arrangement of a locomotive.

BACKGROUND

A diesel-electric locomotive typically includes a diesel internal combustion engine coupled to drive a rotor of at least one traction alternator to produce alternating current (AC) electrical power. The traction alternator may be electrically coupled to power one or more electric traction motors mechanically coupled to apply torque to one or more axles of the locomotive. The traction motors may include AC motors operable with AC power, or direct current motors operable with direct current (DC) power. For DC motor operation, a rectifier may be provided to convert the AC power produced by the traction alternator to DC power for powering the DC motors.

AC-motor-equipped locomotives typically exhibit better performance and have higher reliability and lower maintenance than DC-motor-equipped locomotives. In addition, more responsive individual motor control may be provided in AC-motor-equipped locomotives, for example, via use of inverter-based motor control. However, DC-motor-equipped locomotives are relatively less expensive than comparable AC-motor-equipped locomotives. Thus, for certain hauling applications, such as when hauling relatively light freight and/or relatively short trains, it may be more cost efficient to use a DC-motor-equipped locomotive instead of an AC-motor-equipped locomotive.

For relatively heavy hauling applications, diesel-electric locomotives are typically configured to have two trucks including three powered axles per truck. Each axle of the truck is typically coupled, via a gear set, to a respective motor mounted in the truck near the axle. Each axle is mounted to the truck via a suspension assembly that typically includes one or more springs for transferring a respective portion of a locomotive weight (including a locomotive body weight and a locomotive truck weight) to the axle while allowing some degree of movement of the axle relative to the truck.

A locomotive body weight is typically configured to be about equally distributed between the two trucks. The locomotive weight is usually further configured to be symmetrically distributed among the axles of the trucks. For example, a conventional locomotive weighing 420,000 pounds is typically configured to equally distribute weight to the six axles of the locomotive, so that each axle supports a force of 420,000/6 pounds per axle, or 70,000 pounds per axle.

Locomotives are typically manufactured to distribute weight symmetrically to the trucks and then to the axles of the trucks so that relatively equal portions of the weight of the locomotive are distributed to the axles. Typically, the weight of the locomotive and the power rating of the locomotive determine a tractive effort capability rating of the locomotive that may be expressed as weight times a tractive effort rating. Accordingly, the weight applied to each of the axles times the tractive effort that can be applied to the axle determines a power capability of the corresponding axle. Consequently, the heavier a locomotive, the more tractive effort that it can generate at a certain speed. Additional weight, or ballast, may be added to a locomotive to bring it up to a desired overall weight for achieving a desired tractive effort capability rating. For example, due to manufacturing tolerances that may result in varying overall weights among locomotives built to a same specification, locomotives are commonly configured to be slightly lighter than required to meet a desired tractive effort rating, and then ballast is added to reach a desired overall weight capable of meeting the desired tractive effort rating.

Diesel engine powered locomotives represent a major capital expenditure for railroads, including both the initial purchase of a locomotive, but also the ongoing expense of maintaining and repairing the locomotive. In addition, hauling requirements may change over time for the railroad, so that a locomotive having a certain operating capability at a time of purchase may not meet the hauling needs of the railroad in the future. For example, a railroad looking to purchase a locomotive may only have minimal hauling needs that may be met by a relatively inexpensive low tractive effort capability locomotive, such as a DC powered locomotive having less hauling capability compared to a more expensive relatively high tractive effort locomotive, such as an AC powered locomotive. However, at some point in the useful life of the low tractive effort capability locomotive, hauling needs of the railroad may change, such that the low tractive effort capability locomotive may not be able to provide sufficient hauling capability. As a result, the railroad may need to purchase a more capable high tractive effort capability locomotive, thereby sacrificing a remaining useful life of the low tractive effort capability locomotive.

The inventors have recognized that by manufacturing one type of an item, instead of various different types of the item, a manufacturer may be able to reduce manufacturing costs by streamlining production lines. For example, a locomotive manufacturer may be able to reduce manufacturing costs by producing a single type of locomotive, such as a high tractive effort capability AC powered locomotive, instead of producing two types of locomotives, such as a high tractive effort capability AC powered locomotive and a low tractive effort capability DC powered locomotive. Thus, what is needed is a locomotive that, for example, may be easily reconfigured as operating requirements for the locomotive change over its life. There is also a continuing need to reduce manufacturing and equipment costs. Accordingly, the inventors have innovatively developed a reconfigurable locomotive that may be ballasted using less weight than typically required and may allow for elimination of a need for costly ballast altogether.

BRIEF SUMMARY

An example embodiment of the invention includes a system for modification of a baseline ballast arrangement of a locomotive (or other rail vehicle) having an overall tractive effort rating based on symmetrical distribution of weight and driving torque applied by the locomotive to the respective axles of the locomotive. The system includes a locomotive truck comprising a first axle and a second axle, the first axle of the truck uncoupled from a traction system of the locomotive, and the second axle of the truck coupled to the traction system of the locomotive, a first suspension assembly coupling the first axle to the truck configured to apply to the first axle a first portion of a locomotive weight; and a second suspension assembly coupling the second axle to the truck configured to apply to the second axle a second portion of the locomotive weight different from the first portion of the locomotive weight applied to the first axle so that the locomotive weight is asymmetrically distributed to the first axle and the second axle. The asymmetrical distribution is configured to allocate more weight to the second axle to transmit a corresponding incremental amount of tractive effort for a given amount of a driving torque applied to the second axle via the traction system of the locomotive, and further wherein an amount of locomotive weight allocated from the first axle to the second axle allows modification of a baseline ballast arrangement by reducing an amount of ballast in the baseline ballast arrangement corresponding to the amount of weight allocated from the first axle to the second axle. The first axle and the second axle comprise axles having substantially equal weight-carrying capability.

In another example embodiment, the invention includes a locomotive (or other rail vehicle) truck comprising a first axle, a second axle, and a third axle, the first axle of the truck uncoupled from a traction system of the locomotive, and the second axle and the third axle of the truck coupled to the traction system of the locomotive, a first suspension assembly coupling the first axle to the truck configured to apply to the first axle a first portion of a locomotive weight, a second suspension assembly coupling the second axle to the truck configured to apply to the second axle a second portion of the locomotive weight, and a third axle of the locomotive truck coupled to the traction system of the locomotive. The first axle, the second axle and the third axle comprise axles having substantially equal weight-carrying capability. The system also includes a third suspension assembly coupling the third axle to the truck configured to apply to the third axle a third portion of the locomotive weight; the second portion of the locomotive weight and the third portion of the locomotive weight applied to the respective second axle and third axle different from the first portion of the locomotive weight applied to the first axle so that the locomotive weight is asymmetrically distributed to the first axle, the second axle, and the third axle, wherein the asymmetrical distribution is configured to allocate more weight to the second axle and the third axle to transmit corresponding incremental amounts of tractive effort for a given amount of a driving torque applied to the second axle and the third axle via the traction system of the locomotive, and further wherein an amount of locomotive weight allocated from the first axle to the second axle and the third axle allows modification of a baseline ballast arrangement by reducing an amount of ballast in the baseline ballast arrangement corresponding to the amount of locomotive weight allocated from the first axle to the second axle and the third axle.

In another example embodiment, the invention includes a method for modification of a baseline ballast arrangement of a locomotive (or other rail vehicle) having an overall tractive effort rating based on symmetrical distribution of weight and driving torque applied by the locomotive to the respective axles of the locomotive. The method includes providing a locomotive truck comprising a first axle and a second axle, the first axle of the truck uncoupled from a traction system of the locomotive, and the second axle of the truck coupled to the traction system of the locomotive and coupling the first axle to the truck with a first suspension assembly configured to apply to the first axle a first portion of a locomotive weight. The method also includes uncoupling a first axle of the locomotive truck from a traction system of the locomotive and coupling the first axle to the truck with a first suspension assembly configured to apply to the first axle a first portion of a locomotive weight. The method also includes coupling the second axle to the truck with a second suspension assembly configured to apply to the second axle a second portion of the locomotive weight different from the first portion of the locomotive weight being applied to the first axle, so that the locomotive weight is asymmetrically distributed to the first axle and the second axle, wherein the asymmetrical distribution is configured to allocate more weight to the second axle to transmit a corresponding incremental amount of tractive effort for a given amount of a driving torque applied to the second axle via the traction system of the locomotive. The first axle and the second axle are chosen to have substantially equal weight-carrying capability. The method further includes modifying a baseline ballast arrangement of the locomotive by reducing an amount of ballast in the baseline ballast arrangement corresponding to an amount of weight allocated from the first axle to the second axle.

BRIEF DESCRIPTION OF THE DRAWINGS

A more particular description of the invention briefly described above will be rendered by reference to specific embodiments thereof that are illustrated in the appended drawings. These drawings depict only typical embodiments of the invention and are not therefore to be considered to be limiting of its scope.

DETAILED DESCRIPTION

Figure 1A:
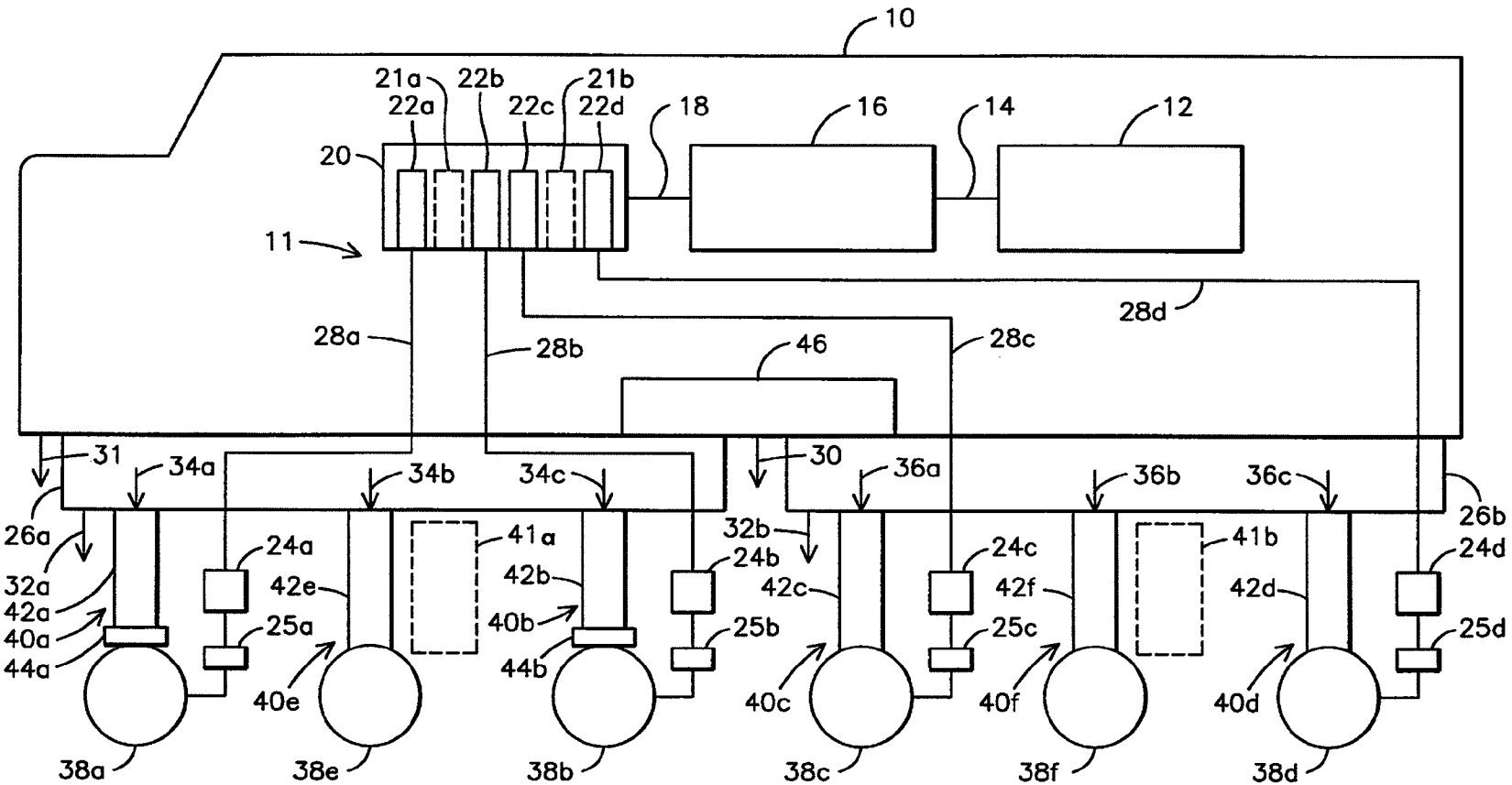
FIG. 1A is a schematic block diagram of an example embodiment of a system for modification of a baseline ballast arrangement of a locomotive.

Reference will now be made in detail to the embodiments consistent with the invention, examples of which are illustrated in the accompanying drawings. Wherever possible, the same reference numerals are used throughout the drawings and refer to the same or like parts.

FIG. 1A is a schematic block diagram of an example embodiment of a reconfigurable rail vehicle, such as a locomotive 10. The locomotive 10 may include a traction system 11 having a diesel internal combustion engine 12 coupled via shaft 14 to drive a traction alternator 16 for producing AC electrical power 18. The AC electrical power 18 may be provided to a motor controller 20 that may include a one or more inverters 22*a*-22*d*. Inverters 22*a*-22*d* may be configured for providing electrical power to, and for controlling respective traction motors 24*a*-24*d* located in trucks 26*a*-26*b*. The inverters 22*a*-22*d* may be electrically coupled to the respective traction motors 24*a*-24*d* with wiring harnesses 28*a*-28*b*. In an aspect of the invention, the traction motors 24*a*-24*d* may include AC powered traction motors for converting AC electrical power into a mechanical power. The traction motors 24*a*-24*d* may be mechanically coupled to respective gear sets 25*a*-25*d* configured to apply power in the form of driving torque to the corresponding powered axle 38*a*-38*d*. It should be understood that although an AC type locomotive system is described above, aspects of the present invention may also be used with DC locomotives and other locomotive power configurations as well.

A static weight 30 of the locomotive 10, for example, including a locomotive body weight 31 and truck weights 32*a*, 32*b*, is supported by the axles 38*a*-38*f* of the trucks 26*a*-26*b*. Accordingly, the static weight 30 supported by any one axle may include a portion of the locomotive body weight 31 of the locomotive 10 supported by the truck to which the axle is coupled and the truck weight, e.g., truck weight 32*a*, 32*b*. The axles 38*a*-38*f* may be coupled to the trucks by 26*a*, 26*b* one or more suspension assemblies 40*a*-40*f* that may include one or more springs 42*a*-42*f* and/or shims 44*a*, 44*b*.

In an embodiment, each of the axles of the trucks has substantially the same weight/normal force capability. This means that all the axles have substantially equal weight-carrying capability, meaning equal but for standard manufacturing tolerances or nominal deviations, as will be readily understood by one skilled in the art. It will be appreciated that the total axle weight has both static and dynamic components, which in one example embodiment may combine to yield values on the order of approximately 120% of a nominal static weight. It will be appreciated that the magnitude of the static weight distribution achieved in accordance with aspects of the present invention will not require any structural modifications for the axles of the truck to accommodate the magnitude of the static weight distribution. This means that the axles are structurally the same, subject to standard manufacturing tolerances or nominal deviations, as will be readily understood by one skilled in the art.

In an aspect of the invention, one or more axles of trucks 26*a*, 26*b*, such as axles 38*e*, 38*f*, may be left un-powered in a baseline configuration. Consequently, the associated assemblies normally deployed with the un-powered axles, such as inverters, traction motors, and/or gear sets, may be absent in a baseline configuration. By reducing a number of traction components, users requiring a less tractive effort capable and/or less powerful locomotive may be able to save on the cost of purchasing such a locomotive compared to a locomotive having a full complement of traction components. Furthermore, manufacturers of such locomotives may save on production costs because they only need to produce one baseline locomotive design and simply add traction components and/or refrain for installing traction components to achieve a desired capability of a locomotive, instead of having to produce entirely different models having different capabilities. Spaces in the locomotive 10 normally occupied by components of the traction system 11, such as a space 41*a* in the truck 26*a* normally reserved for housing a traction assembly, and or a space 21*a* in the motor controller 20, normally reserved for an inverter, may be left vacant in a baseline locomotive design.

In an example embodiment, the invention includes a system for modification of a baseline ballast arrangement of a locomotive 10. The locomotive 10 may have an overall tractive effort rating based on symmetrical distribution of weight and driving torque applied by the locomotive 10 to the respective axles 38*a*-38*f* of the locomotive 10. The system includes a locomotive truck, e.g. truck 26*a*, for distributing weight asymmetrically to axles, e.g. a first axle 38*a* and a second axle 38*e*, of the truck 26*a*. Axle 38*e* of a locomotive truck 26*a* may be uncoupled from the traction system 11 of the locomotive 10 and a suspension assembly 40*e* may couple axle 38*e* to the truck 26*a* configured to apply to axle 38*e* a first portion 34*b* of the weight 30 of the locomotive 10. Accordingly, axle 38*e* may be configured to act as an un-powered, idler axle that functions to support portion 34*b* of the locomotive weight 30 in the absence of the traction system components normally needed to drive the axle 38*e*. Axle 38*a* of the locomotive truck 26*a* may be coupled to the traction system 11, and a suspension assembly 40*a* may couple the axle 38*a* to the truck 26*a* configured to apply to the axle 38*a* a second portion 34*a* of the weight 30. Portion 34*b* may be different from portion 34*a* of the weight 30 being applied to the axle 38*a* so that the locomotive weight 30 is asymmetrically distributed to axle 38*e* and axle 38*a*. Advantageously, this asymmetrical distribution of weight may be configured to allocate more weight to axle 38*a* and be effective to transmit a corresponding incremental amount of tractive effort for a given amount of a driving torque applied to the axle 38*a* via the traction system 11 of the locomotive 10. Furthermore, an amount of weight allocated from axle 38*e* to axle 38*a* allows modification of a baseline ballast arrangement by reducing an amount of ballast in the baseline ballast arrangement corresponding to the amount of weight allocated from axle 38*e* to axle 38*a*.

By way of explanation, a ballasted locomotive weighing 420,000 pounds may typically be configured to equally distribute weight to six axles 38*a*-38*f* so that each axle 38*a*-38*f* supports a weight 34*a*-34*f* of 420,000/6 pounds per axle, or 70,000 pounds per axle. However, if two of the axles 38*e*, 38*f* are left un-powered as shown in the locomotive 10 of FIG. 1A, then only 280,000 pounds (4 powered axles times 70,000 pounds per axle) of weight is available to develop tractive effort by the four powered axles 38*a*-38*d*. In a reduced power configuration having four powered axles 38*a*-38*d* and two un-powered axles 38*e*, 38*f*, it may be sufficient for hauling purposes to have a lower locomotive weight, such as 390,000 pounds. However, if weight is allocated symmetrically among the wheels as in the six powered axle case, that is, 70,000 pounds per axle, only 280,000 pounds (70,000 pounds per axle times 4 axles) would be available for use in generating tractive effort. Consequently, an additional 110,000 pounds (390,000 pounds-280,000 pounds per powered axle) of ballast 46 may need to be added to the locomotive 10. Innovatively, by allocating weight among the powered axles 38*a*-38*d* and un-powered axles 38*e*, 38*f*, a need for ballast may be reduced, or eliminated altogether. For example, if 55,000 pounds is relieved from each of the un-powered axles 38*e*, 38*f*, of the trucks 26*a*, 26*b* and added to the powered axles 38*a*-38*d* of the trucks 26*a*, 26*b*, each of the powered axles 38*a*-38*d* supports a weight of 98,000 pounds, or about an extra 28,000 per powered axle over the 70,000 pounds conventionally allocated. This allocation has the effect of providing an additional 110,000 pounds of weight. Consequently, no additional ballast would be needed to bring the locomotive up to a desired weight of 390,000. The same tractive effort may be generated by the four powered axles having the additional allocated weight as if the locomotive 10 was ballasted up to 390,000.

Figure 1B:
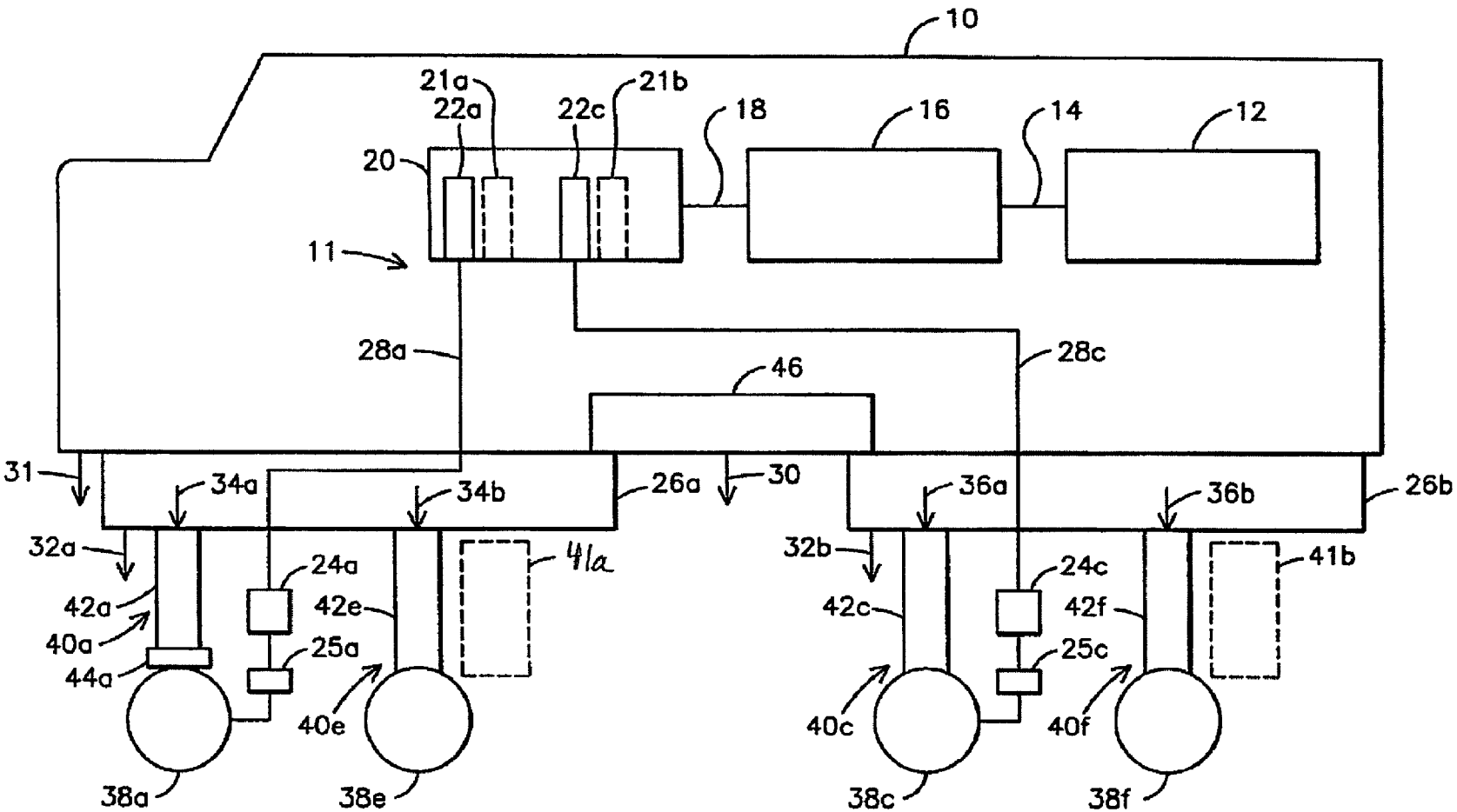
FIG. 1B is a schematic block diagram of another example embodiment of a system for modification of a baseline ballast arrangement of a locomotive.

Accordingly, in an embodiment of the invention depicted in FIG. 1B, the portion 34*a* of the weight 30 applied to axle 38*a* coupled to the traction system 11 may be greater than portion 34*b* of the weight 30 applied to the axle 38*e* uncoupled from the traction system so that more of the weight 30 is allocated to axle 38*a*. Weight may be transferred from an un-powered axle 38*e* that does not provide tractive effort, to a powered axle 38*a*, so that more tractive effort may be generated by axle 38*a* compared to a conventional configuration wherein the weight 30 is symmetrically distributed to the axles 38*a*, 38*b*. For example, if 5000 pounds of weight normally applied to axle 38*e* is relieved from bearing on axle 38*e* and allocated to axle 38*a*, an additional tractive effort proportional to the additional 5000 pounds allocated to axle 38*a* may be transmitted by axle 38*a*. Advantageously, by allocating more weight to the powered axle 38*a*, adhesion control may be improved compared to an arrangement wherein weight is symmetrically allocated to the axles 38*a* and 38*e*.

In an example embodiment for distributing weight asymmetrically to reduce a ballast requirement, suspension assembly 40*a* and suspension assembly 40*e* may comprise respective springs 42*a*, 42*b* having different characteristics that provided different weight loading responses. For example, the different characteristics may comprise different spring constants and/or different spring geometries. For example, spring 42*a* may comprise a stiffer spring constant than a spring constant of spring 42*e*. In another embodiment, the different spring geometry may include a different spring length in a direction of spring compression. For example, a length of spring 42*a* may be longer than a length of spring 42*e*. In another embodiment, suspension assembly 40*a* and suspension assembly 40*e* may include respective springs 42*a*, 42*b* having equivalent characteristics, wherein at least one of the suspension assembly 40*a* and suspension assembly 40*e* include a shim, e.g. shim 44*a*, for configuring the corresponding suspension assembly e.g. 42 to have a different characteristic than the other suspension assembly, e.g. 40*e*. For example, shim 44*a* may effectively shorten, or pre-compress, spring 42*a* so that more weight is allocated to axle 38*a* compared to an un-shimmed suspension assembly 40*e* including a spring 42*e* having an equivalent characteristic as spring 42*a*.

In yet another embodiment shown in FIG. 1A, the locomotive truck may include a third axle, e.g. axle 38*b*, coupled to the traction system 11 of the locomotive 10 and another suspension assembly 40*b* coupling axle 38*b* to the truck 26*a* configured to apply to the axle 38*b* a third portion 34*c* of the weight 30. Portion 34*c* applied to the axle 38*b* may be different from portion 34*b* applied to axle 38*e* so that the weight 30 is asymmetrically distributed to axle 38*a*, axle 38*e*, and axle 38*c*. The asymmetrical distribution may be configured to allocate more weight to axle 38*a* and axle 38*c* effective to allow to transmit a corresponding incremental amount of tractive effort for a given amount of a driving torque applied to axle 38*a* and axle 38*c* via the traction system 11 of the locomotive 10. For example, portion 34*a* and portion 34*c* applied to the respective axle 38*a* and axle 38*c* may be greater than the portion 34*b* of the weight 30 applied to axle 38*e*, so that more weight is allocated to axle 38*a* and axle 38*c*. In another aspect, the weights allocated to axle 38*a* and axle 38*c* may be symmetric with respect to each other, but different than the weight allocated to axle 38*e*.

The examples below represent asymmetrical axle weight distribution in accordance with aspects of the present invention, where the values are listed in a descending numerical order regarding the magnitude of asymmetrical axle weight distribution. In a first example, the asymmetrical axle weight distribution may be represented by the following weight axle ratios, 74/60/74. It is believed that the ratios of the first example may approximate an upper bound that takes into account various considerations regarding the extent to which static weight can be practically shifted to the powered axles. These considerations may include rail forces, the impact on friction braking related wheel to rail adhesion required to avoid slides, as well as truck component stress.

In a second example, the asymmetrical axle weight distribution may be represented by the following weight axle ratios, 72/64/72. In a third example, the normalized asymmetrical axle weight distribution may be represented by the following weight axle ratios 70/68/70. It is believed that the distribution values of the third example may approximate a lower bound regarding static weight shifting of practical utility. It will be appreciated that the foregoing values (upon rounding) correspond to an example range from approximately 55%/45% weight distribution to approximately 51%/49% distribution, where a second axle coupled to the traction system carries the larger percentage relative to a first axle uncoupled from the traction system. It will be appreciated that the foregoing values (upon rounding) in a three-way percentage distribution correspond to a range from approximately 33.6%, 32.7%, 33.6% to approximately 35.5%, 29.0%, 35.5%, where a second axle and a third axle coupled to the traction system carry the larger percentage values relative to a first axle uncoupled from the traction system, and where the first axle is positioned between the second and the third axles. The first axle comprises an axle similar in capacity to the second and third axles. For example, in the event the locomotive were to be reconfigured so that the first axle is coupled to the traction system of the locomotive, the first axle can accept and withstand tractive effort from the traction system of the locomotive.

In view of the foregoing considerations, it will be appreciated that the weight distribution achieved in accordance with aspects of the present invention represents a relatively slight weight distribution compared to a nominal weight normally carried by the axles, and as noted above, this means that all the axles have the same weight-carrying capability, subject to manufacturing tolerances or nominal deviations, as will be understood by one skilled in the art.

In another embodiment, suspension assemblies 40*a*, 40*e* and 40*b*, include respective springs 42*a*, 42*e* and 42*b* having different characteristics. The different characteristics may include different spring constants and/or different characteristics comprise different spring geometries. In another example embodiment, springs 42*a*, 42*e* and 42*b* may include equivalent characteristics, wherein at least one of the first suspension assemblies 40*a*, 40*e* and 40*b* include a shim, such as shims 44*a*, 44*b* for configuring the corresponding suspension assembly to have a different characteristic than the other suspension assemblies.

Figure 2:
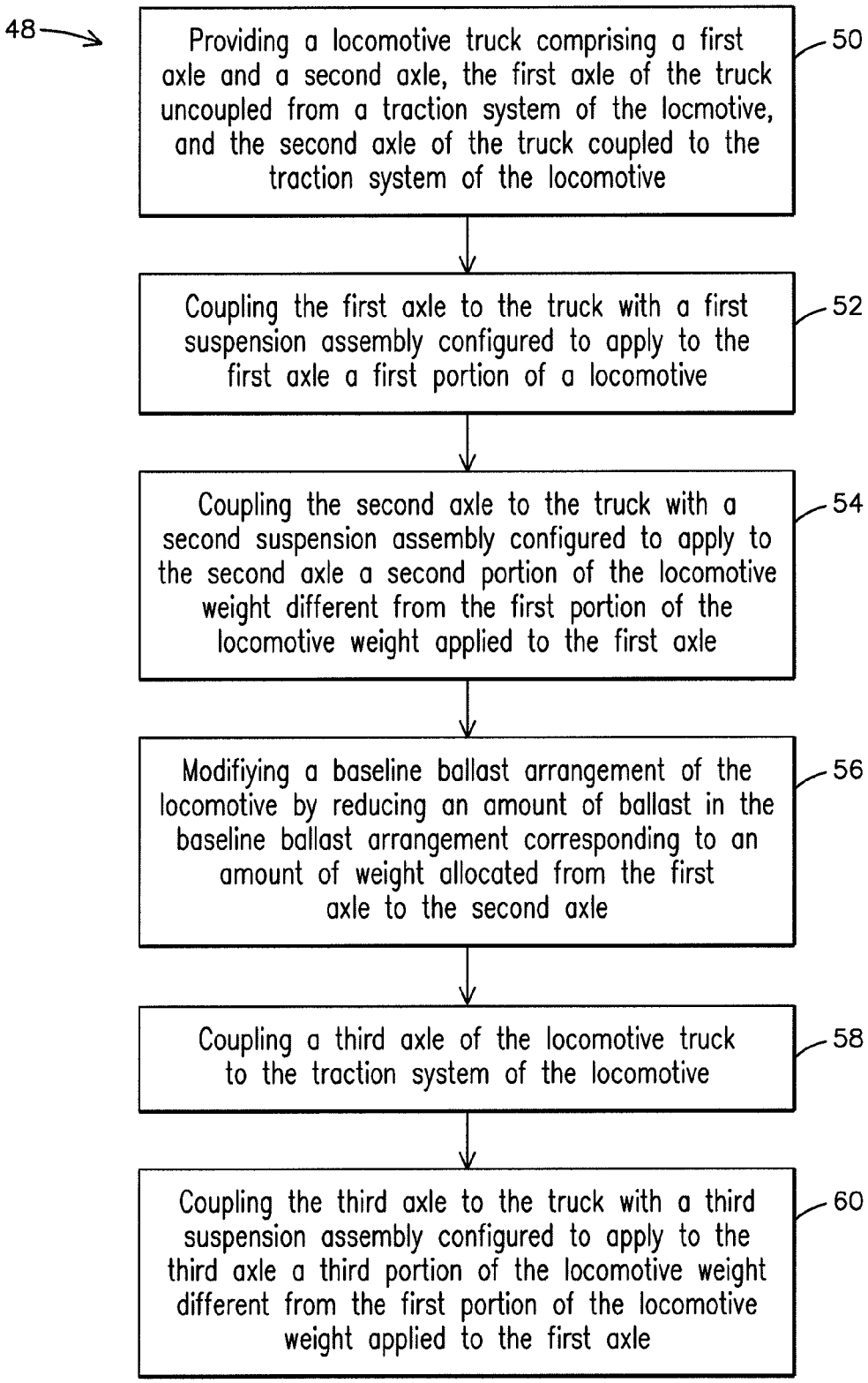
FIG. 2 is a flow diagram of an example embodiment of a method for modification of a baseline ballast arrangement of a locomotive.

In another example embodiment depicted in the flow diagram 48 of FIG. 2, and with reference to FIGS. 1A and 1B, a method for modification of a baseline ballast arrangement of locomotive 10 having an overall tractive effort rating based on symmetrical distribution of weight 30 and driving torque applied by the locomotive 10 to the respective axles 38*a*-38*f* of the locomotive 10 is shown. The method may include providing 50 a locomotive truck, e.g. truck 26*a*, that includes, for example, a first axle 38*a* and a second axle 38*e*, wherein axle 38*e* of the truck 26*a* is uncoupled from a traction system 11 of the locomotive 10, and axle 38*e* of the truck is coupled to the traction system 11. The method may also include coupling 52 axle 38*e* to the truck 26*a* with a first suspension assembly 40*e* configured to apply to axle 38*e* a first portion 34*b* of locomotive weight 30.

The method may also include coupling 54 the axle 38*a* to the truck 26*a* with a second suspension assembly 40*a* configured to apply to axle 38*a* portion 34*a* of the locomotive weight 30 different from portion 34*b* of the locomotive weight 30 being applied to axle 38*e* so that the locomotive weight 30 is asymmetrically distributed to axle 38*e* and axle 38*a*. The asymmetrical distribution may be configured to allocate more of the locomotive weight to axle 38*a* to transmit a corresponding incremental amount of tractive effort for a given amount of a driving torque applied to axle 38*a* via the traction system 11 of the locomotive 10. The method may further include modifying 56 a baseline ballast arrangement of the locomotive 10 by reducing an amount of ballast e.g. 46, in the baseline ballast arrangement corresponding to an amount of locomotive weight allocated from the axle 38*e* to axle 38*a*. The method may also include coupling 58 a third axle, e.g. axle 38*b* of the locomotive truck 26*a* to the traction system 11 of the locomotive 10 and coupling 60 axle 38*b* to the truck 26*a* with a third suspension assembly configured to apply to axle

38*b* a third portion 34*c* of the weight 30 different from the first portion 34*b* of the weight 30 being applied to axle 38*e*.

While exemplary embodiments of the invention have been described with reference to an exemplary embodiment, it will be understood by those skilled in the art that various changes, omissions and/or additions may be made and equivalents may be substituted for elements thereof without departing from the spirit and scope of the invention. In addition, many modifications may be made to adapt a particular situation or material to the teachings of the invention without departing from the scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A system for modification of a baseline ballast arrangement of a rail vehicle having an overall tractive effort rating based on symmetrical distribution of weight and driving torque applied by the rail vehicle to axles of the rail vehicle, the system comprising:

a rail vehicle truck comprising a first axle and a second axle, the first axle of the truck uncoupled from a traction system of the rail vehicle, the second axle of the truck coupled to the traction system of the rail vehicle;

a first suspension assembly including a first spring, the first suspension assembly coupling the first axle to the truck, the first suspension assembly having mechanical characteristics to apply a first portion of a rail vehicle weight to the first axle; and a second suspension assembly including a second spring, the second suspension assembly coupling the second axle to the truck, the first and second springs having at least one of different spring constants or different spring geometries, the second suspension assembly having mechanical characteristics different than the mechanical characteristics of the first suspension assembly to apply a second portion of the rail vehicle weight to the second axle that is different from the first portion of the rail vehicle weight applied to the first axle so that the rail vehicle weight is asymmetrically distributed to the first axle and the second axle, wherein the asymmetrical distribution of the rail vehicle weight is configured to allocate more weight to the second axle to transmit a corresponding incremental amount of tractive effort for a given amount of a driving torque applied to the second axle via the traction system of the rail vehicle, and further wherein an amount of the rail vehicle weight allocated from the first axle to the second axle allows modification of a baseline ballast arrangement by reducing an amount of ballast in the baseline ballast arrangement corresponding to the amount of rail vehicle weight allocated from the first axle to the second axle, wherein the first axle and the second axle comprise axles having substantially equal weight-carrying capability.

2. The system of claim 1, wherein, at least one of the first suspension assembly and the second suspension assembly further comprising a shim for configuring the corresponding suspension assembly to have a different characteristic than the other suspension assembly.

3. The system of claim 1, wherein the rail vehicle weight comprises a rail vehicle body weight of the rail vehicle supported by the truck and a truck weight.

4. The system of claim 1, wherein the traction system comprises an alternating current traction motor.

5. A rail vehicle comprising the system of claim 1.

6. The system of claim 1, further comprising:

a second truck in addition to the truck of claim 1, the second truck comprising a third axle and a fourth axle coupled to the traction system; and a rail vehicle ballast disposed on the rail vehicle closer to the second truck than the truck of claim 1 so that weight of the rail vehicle ballast is asymmetrically distributed to the second truck and the truck of claim 1 so as to allow transmitting a corresponding incremental amount of tractive effort for a given amount of a driving torque applied to the third axle and fourth axle of the second truck via the traction system of the rail vehicle.

7. The system of claim 1, wherein the asymmetrical distribution of the rail vehicle weight to the second axle and the first axle comprises a range from a 55%/45% weight distribution to a 51%/49% weight distribution.

8. A system for modification of a baseline ballast arrangement of a rail vehicle having an overall tractive effort rating based on symmetrical distribution of weight and driving torque applied by the rail vehicle to axles of the rail vehicle, the system comprising:

a rail vehicle truck comprising a first axle, a second axle, and a third axle, the first axle of the truck uncoupled from a traction system of the rail vehicle, and the second axle and the third axle of the truck coupled to the traction system of the rail vehicle;

a first suspension assembly comprising a first spring and coupling the first axle to the truck, the first suspension assembly having respective mechanical characteristics to apply a first portion of a rail vehicle weight to the first axle;

a second suspension assembly comprising a second spring and coupling the second axle to the truck, the second suspension assembly configured to apply a second portion of the rail vehicle weight to the second axle;

a third axle of the rail vehicle truck coupled to the traction system of the rail vehicle, wherein the first axle, the second axle, and the third axle comprise axles having substantially equal weight-carrying capability; and a third suspension assembly comprising a third spring and coupling the third axle to the truck, the third suspension assembly configured to apply a third portion of the rail vehicle weight to the third axle, the first spring, the second spring, and the third spring having at least one of different spring constants or different spring geometries, wherein the second suspension assembly and the third suspension assembly have respective mechanical characteristics different than the mechanical characteristics of the first suspension assembly so that the second portion of the rail vehicle weight and the third portion of the rail vehicle weight applied to the respective second axle and third axle are different from the first portion of the rail vehicle weight applied to the first axle, wherein the rail vehicle weight is asymmetrically distributed to the first axle, the second axle, and the third axle, wherein the asymmetrical distribution of the rail vehicle weight is configured to allocate more weight to the second axle and the third axle to transmit corresponding incremental amounts of tractive effort for a given amount of a driving torque applied to the second axle and the third axle via the traction system of the rail vehicle, and further wherein an amount of the rail vehicle weight that is allocated from the first axle to the second axle and the third axle allows for modification of a baseline ballast arrangement by reducing an amount of ballast in the baseline ballast arrangement corresponding to the amount of the rail vehicle weight that is allocated from the first axle to the second axle and the third axle.

9. The system of claim 8, wherein at least one of the first suspension assembly, the second suspension assembly, or the third suspension assembly further comprises a shim for configuring the corresponding suspension assembly to have a different characteristic than at least one other suspension assembly.

10. The system of claim 8, wherein the rail vehicle weight comprises a rail vehicle body weight of the rail vehicle supported by the truck and a weight of the rail vehicle truck.

11. The system of claim 8, wherein the traction system comprises an alternating current traction motor.

12. A rail vehicle comprising the system of claim 8.

13. The system of claim 8, wherein the first axle is located between the second axle and the third axle.

14. The system of claim 8, wherein the second portion and the third portion of the rail vehicle weight that are applied to the second axle and the third axle, respectively, are symmetrical relative to each other and asymmetrical relative to the first portion of the rail vehicle weight that is applied to the first axle.

15. The system of claim 8, wherein the asymmetrical distribution of the rail vehicle weight to the second axle, the first axle, and the third axle comprises a range from a 33.6%/32.7%/33.6% weight distribution to a 35.5%/29.0%/35.5% weight distribution.

16. A method for modification of a baseline ballast arrangement of a rail vehicle having an overall tractive effort rating based on symmetrical distribution of weight and driving torque applied by the rail vehicle to axles of the rail vehicle, the method comprising:

providing a rail vehicle truck comprising a first axle and a second axle, the first axle of the truck uncoupled from a traction system of the rail vehicle, the second axle of the truck coupled to the traction system of the rail vehicle;

coupling the first axle to the truck with a first suspension assembly having a first spring;

configuring the first suspension assembly with mechanical characteristics to apply a first portion of a rail vehicle weight to the first axle;

coupling the second axle to the truck with a second suspension assembly having a second spring, the first and second springs having at least one of different spring constants or different spring geometries;

choosing the first axle and the second axle to have substantially equal weight-carrying capabilities;

configuring the second suspension assembly with mechanical characteristics that are different from the mechanical characteristics of the first suspension assembly to apply a second portion of the rail vehicle weight to the second axle that is different from the first portion of the rail vehicle weight that is applied to the first axle such that the rail vehicle weight is asymmetrically distributed among the first axle and the second axle, wherein the asymmetrical distribution of the rail vehicle weight is configured to allocate more weight to the second axle to transmit a corresponding incremental amount of tractive effort for a given amount of a driving torque applied to the second axle via the traction system of the rail vehicle; and modifying a baseline ballast arrangement of the rail vehicle by reducing an amount of ballast in the baseline ballast arrangement corresponding to an amount of weight that allocated from the first axle to the second axle.

17. The method of claim 16, further comprising:

coupling a third axle of the rail vehicle truck to the traction system of the rail vehicle; and coupling the third axle to the truck with a third suspension assembly configured to apply a third portion of the rail vehicle weight to the third axle, the third portion of the rail vehicle weight being different from the first portion of the rail vehicle weight that is applied to the first axle.

18. A system comprising:

a first rail vehicle truck comprising an unpowered axle that is decoupled from a traction system and a first powered axle that is coupled with the traction system;

a first suspension assembly coupling the unpowered axle to the first rail vehicle truck, the first suspension assembly including a first spring to apply a first portion of rail vehicle weight to the unpowered axle; and a second suspension assembly coupling the first powered axle to the first rail vehicle truck, the second suspension assembly including a second spring to apply a second portion of the rail vehicle weight to the first powered axle, the first and second springs of the respective first and second suspension assemblies having at least one of different spring constants or different spring geometries such that the second portion of the rail vehicle weight that is applied to the first powered axle is greater than the first portion of the rail vehicle weight that is applied to the unpowered axle in order to provide an asymmetrical distribution of the rail vehicle weight.

19. The system of claim 18, wherein the first rail vehicle truck includes a baseline ballast arrangement and a tractive effort rating that is based on a symmetrical distribution of the rail vehicle weight and a driving torque that is applied to the first powered axle.

20. The system of claim 19, wherein the asymmetrical distribution of the rail vehicle weight is configured to increase a tractive effort that is provided to the first powered axle from the driving torque generated by the traction system.

21. The system of claim 19, wherein the asymmetrical distribution of the rail vehicle weight is configured to reduce an amount of ballast in the baseline ballast arrangement by a difference between the first and second portions of the rail vehicle weight that are applied to the unpowered axle and the first powered axle, respectively.

22. The system of claim 18, further comprising:

a second truck comprising a second powered axle and a third powered axle coupled to the traction system; and a rail vehicle ballast disposed on the rail vehicle closer to the second truck than the first truck such that that ballast weight of the rail vehicle ballast is asymmetrically distributed among the first truck and the second truck to transmit a tractive effort generated by the traction system to the second powered axle and the third powered axle of the second truck.

* * * * *